US005716691A

United States Patent [19]

Chan

[11] Patent Number: 5,716,691

[45] Date of Patent: Feb. 10, 1998

[54] DISPENSABLE FOLDED WEB PRODUCT

[75] Inventor: Michael Yuwah Chan, Alpharetta, Ga.

[73] Assignee: Kimberly-Clark Corporation, Neenah, Wis.

[21] Appl. No.: 740,827

[22] Filed: Nov. 4, 1996

[51] Int. Cl.[6] ..... B32B 3/04

[52] U.S. Cl. ..... 428/126; 428/130; 221/47

[58] Field of Search ..... 428/126, 130; 221/47

[56] References Cited

U.S. PATENT DOCUMENTS

| | | | |
|---|---|---|---|
| 2,244,630 | 6/1941 | Metternich | 206/57 |
| 2,761,676 | 9/1956 | Sabee et al. | 270/39 |
| 3,241,829 | 3/1966 | Acher | 270/61 |
| 5,242,364 | 9/1993 | Lehmann | 493/8 |
| 5,295,579 | 3/1994 | Focke et al. | 206/494 |
| 5,565,258 | 10/1996 | McConnell et al. | 428/126 |

*Primary Examiner*—Alexander Thomas
*Attorney, Agent, or Firm*—K. V. Sidor

[57] ABSTRACT

A dispensable, folded absorbent web product composed of: a first, central panel; a second panel, unitary with said first panel and folded over a first side of said first panel; a third panel, unitary with the first panel, and folded over a second side of the first panel; a fourth panel, unitary with the second panel, and folded so as to be positioned between the first and second panels; and a fifth panel, unitary with the third panel, and folded so as to be positioned between the first and third panels, such that a portion of the third panel and fifth panel overlap a portion of the second panel and fourth panel generating an area of non-uniform thickness across the length of the product which provides for easier, more reliable dispensing.

21 Claims, 4 Drawing Sheets

DISPENSABLE FOLDED WEB PRODUCT

FIELD OF THE INVENTION

This invention generally relates to folded web products. More specifically, this invention relates folded absorbent paper products, such as a paper napkin used in a conventional napkin dispenser.

BACKGROUND

Folded absorbent paper products, such as the folded paper napkins that are commonly provided in quick-service restaurant napkin dispensers, have been and are in wide use throughout the world. The most common type of paper napkin fold is an overfold napkin illustrated in a cross-sectional view in FIG. 1.

A conventional overfold paper napkin towel 10 typically has a closed end 12 that is defined by a main panel 14 of absorbent paper material and an open end 16 that is defined by second panel 18. An optional third panel 20 may be folded under the second panel 18. The second and third panels 18, 20 are unitary with main panel 14, and are, respectively, connected to main panel 14 at fold lines that are at opposite ends of main panel 14, as may be seen in FIG. 1. A conventional paper napkin may be made of a single ply or a multiple ply material. For example, FIG. 1 shows a two ply material having a first ply 22 and a second ply 24.

One common problem with conventional overfold paper napkins may be seen in reference to FIGS. 2A and 2B. Conventional overfold paper napkins are designed to be stacked in a napkin dispenser 26 such as, for example, a spring loaded napkin dispenser or a gravity feed dispenser. Such napkin dispensers have an opening 28 so that the open end 16 of the napkin 10 faces the opening 28 as shown in FIG. 2A. In this position, a user can grab the second panel 18 to pull the napkin 10 out of the dispenser 26. However, when stacked improperly, as shown in FIG. 2B, with the closed end 12 facing the opening 28, dispensing is awkward, and often results in wastage. Not uncommonly, maintenance personnel will stack overfold paper napkins improperly, as shown in FIG. 2B rather than as shown in FIG. 2A.

Moreover, conventional overfold paper napkins are two to three times as thick where the second panel 18 and the optional third panel 20 are folded over the main panel 14. When such paper napkins are arranged in a stack, the stack will have its greatest thickness across an upper or lower edge 30 of the opening 28 in the dispenser 26 as seen in FIG. 2C. Pressure generated by a spring-loaded dispenser or an overfilled dispenser will force the thickest portion of the stack against the edge 30 of the dispenser 26. If sufficient pressure exists, friction between the edge 30 of the dispenser 26 and the outermost paper napkin will make it difficult to remove a napkin from the dispenser.

Accordingly, a need exists for a dispensable, folded web product, such as a paper napkin, that is virtually impossible to mis-load in a conventional dispenser. There is also a need for a dispensable, folded web product, such as a paper napkin, which is configured so that a stack of the product distributes pressure from a spring-loaded or overfilled dispenser for more reliable dispensing.

SUMMARY OF THE INVENTION

The present invention addresses the problems discuss above by providing a dispensable, folded absorbent web product composed of: a first, central panel; a second panel, unitary with said first panel and folded over a first side of said first panel; a third panel, unitary with the first panel, and folded over a second side of the first panel; a fourth panel, unitary with the second panel, and folded so as to be positioned between the first and second panels; and a fifth panel, unitary with the third panel, and folded so as to be positioned between the first and third panels, such that a portion of the third panel and fifth panel overlap a portion of the second panel and fourth panel generating an area of non-uniform thickness across the length of the product which provides for easier, more reliable dispensing.

The web product may be a continuous web having a first edge and a second opposite edge, the first edge being on the fourth panel opposite to the third fold line and the second edge being on the fifth panel opposite to the fourth fold line.

The folded web product is a fibrous web such as, for example, a nonwoven web of meltblown fibers, a nonwoven web of spunbond filaments, a coform web, a wet-laid web, an air-laid web, a bonded, carded web or the like as well as combinations thereof. Desirably, the folded web product is an absorbent paper product such as, for example, an absorbent paper napkin, an absorbent paper towel or the like. The folded web product may be a single ply or may be composed of a material made up of multiple plies.

According to the invention, the width of the second panel may be greater than the width of the third panel so the folded web product is asymmetrical. In an aspect of the invention, the width of the fourth panel may be less than one-half the width of the second panel. In another aspect of the present invention, the width of the fifth panel may be less than one-half the width of the third panel.

An embodiment of the present invention encompasses a dispensable, unitary folded web product composed of: a first, central panel having first and second opposing surfaces, the first panel concluding at a first fold line at a first end and a second fold line at a second end that is opposite from the first end, the first panel having a width that is defined as a distance from the first fold line to the second fold line; a second panel, the second panel having a first end that is joined with the first panel at the first fold line, and a second end having a third fold line defined thereat, the second panel having a width that is defined as a distance from the first fold line to the third fold line, the second panel being folded so it overlays a portion of the first surface of the first panel; a third panel, the third panel having a first end that is joined with the first panel at the second fold line and a second end having a fourth fold line defined thereat, the third panel having a width that is defined as a distance from the second fold line to the fourth fold line, the third panel being folded so it overlays a portion of the second surface of the first panel; a fourth panel, the fourth panel being joined to the second panel at the third fold line, the fourth panel being folded with respect to the second panel at the third fold line so that the fourth panel is positioned substantially between the first panel and said second panel; and a fifth panel, the fifth panel being joined to the third panel at said fourth fold line, said fifth panel being folded with respect to the third panel at the fourth fold line so that the fifth panel is positioned substantially between the third panel and the first panel. According to the invention, the combined widths of the second panel and the third panel are greater than the first panel so the second and third panels overlap to generate a region of non-uniform thickness across the length of the product.

The web product may be a continuous web having a first edge and a second opposite edge, the first edge being on the fourth panel opposite to the third fold line and the second edge being on the fifth panel opposite to the fourth fold line.

The folded web product is a fibrous web. Desirably, the folded web product is an absorbent paper product such as, for example, an absorbent paper napkin. The folded web product may be a single ply or may be composed of a material made up of multiple plies.

According to the invention, the width of the second panel may be greater than the width of the third panel so the folded web product is asymmetrical. In an aspect of the invention, the width of the fourth panel may be less than one-half the width of the second panel. In another aspect of the present invention, the width of the fifth panel may be less than one-half the width of the third panel.

These and various other advantages and features of novelty which characterize the invention are pointed out with particularity in the claims annexed hereto and forming a part hereof. However, for a better understanding of the invention and its advantages, reference should be made to the drawings which form a further part hereof, and to the accompanying descriptive matter, in which there is illustrated and described a preferred embodiment of the invention.

DETAILED DESCRIPTION

Figure 1:
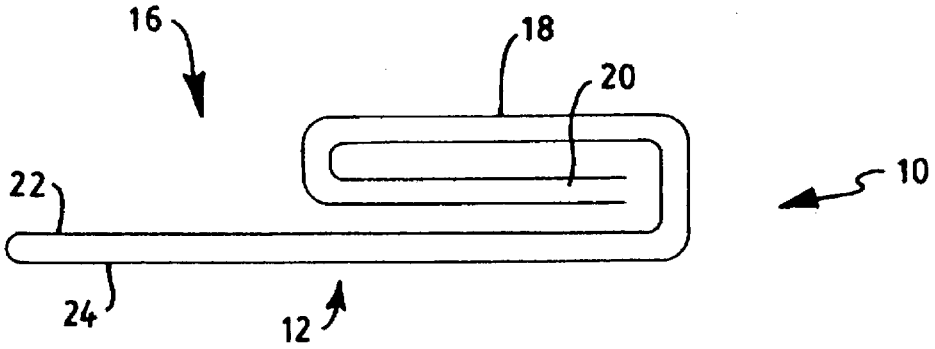
FIG. 1 is a cross sectional depiction of a conventional overfold type dispensable web product.
Figure 2A:
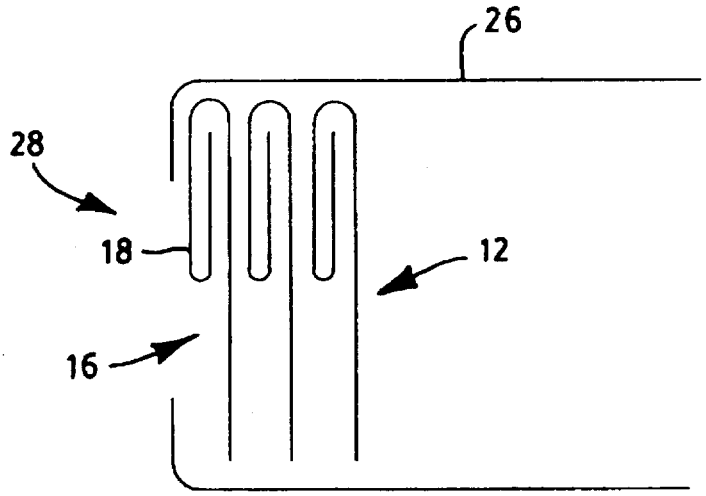
FIG. 2A is an illustration of a properly loaded dispenser containing a conventional overfold type dispensable web product.
Figure 2B:
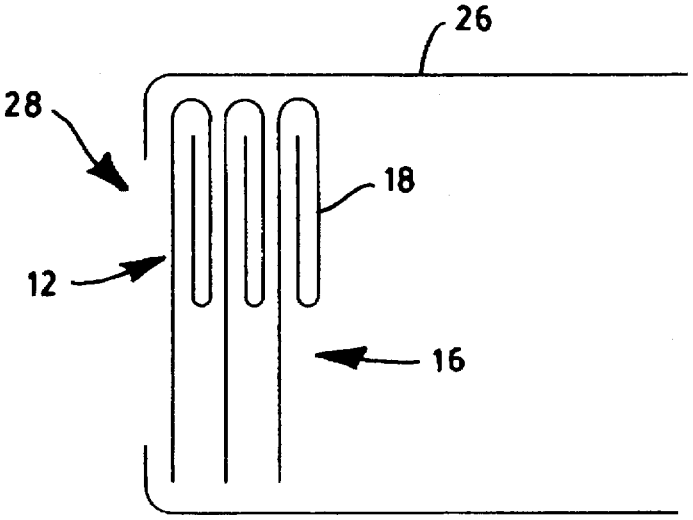
FIG. 2B is an illustration of an improperly loaded dispenser containing a conventional overfold type dispensable web product.
Figure 3:
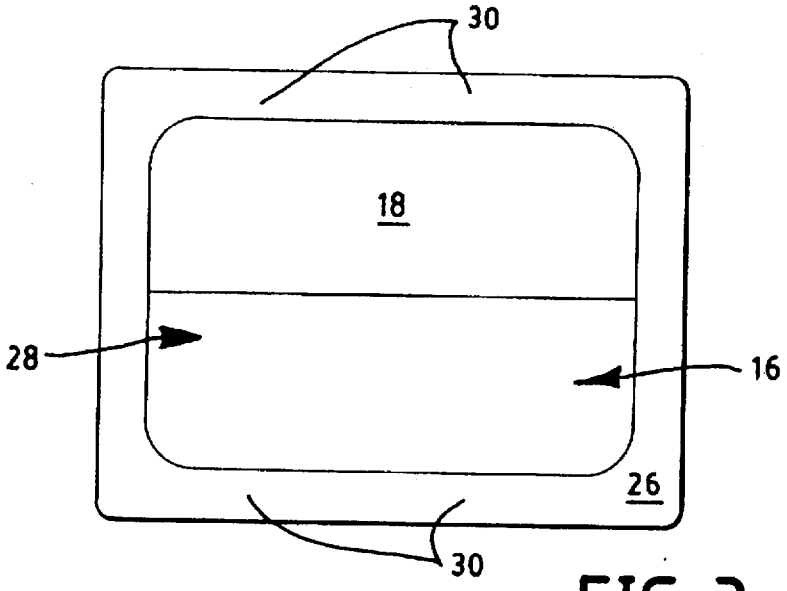
FIG. 3 is a front view illustration of a dispenser containing a conventional overfold type dispensable web product.
Figure 4:
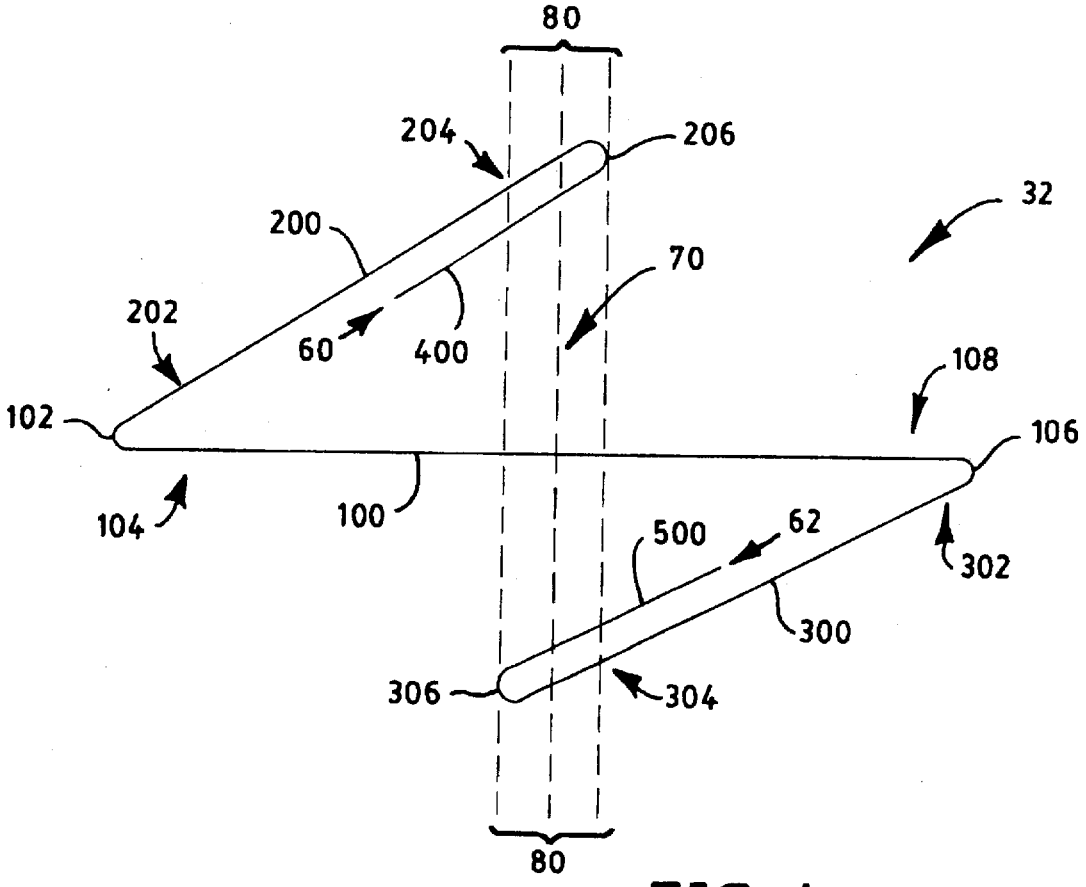
FIG. 4 is an illustration of a cross section of an exemplary improved dispensable folded web product.

Referring now to the drawings, wherein like reference numerals designate corresponding structure throughout the views, and referring in particular to FIG. 4, there is shown (not necessarily to scale) an exemplary improved dispensable folded web product 32.

Figure 5:
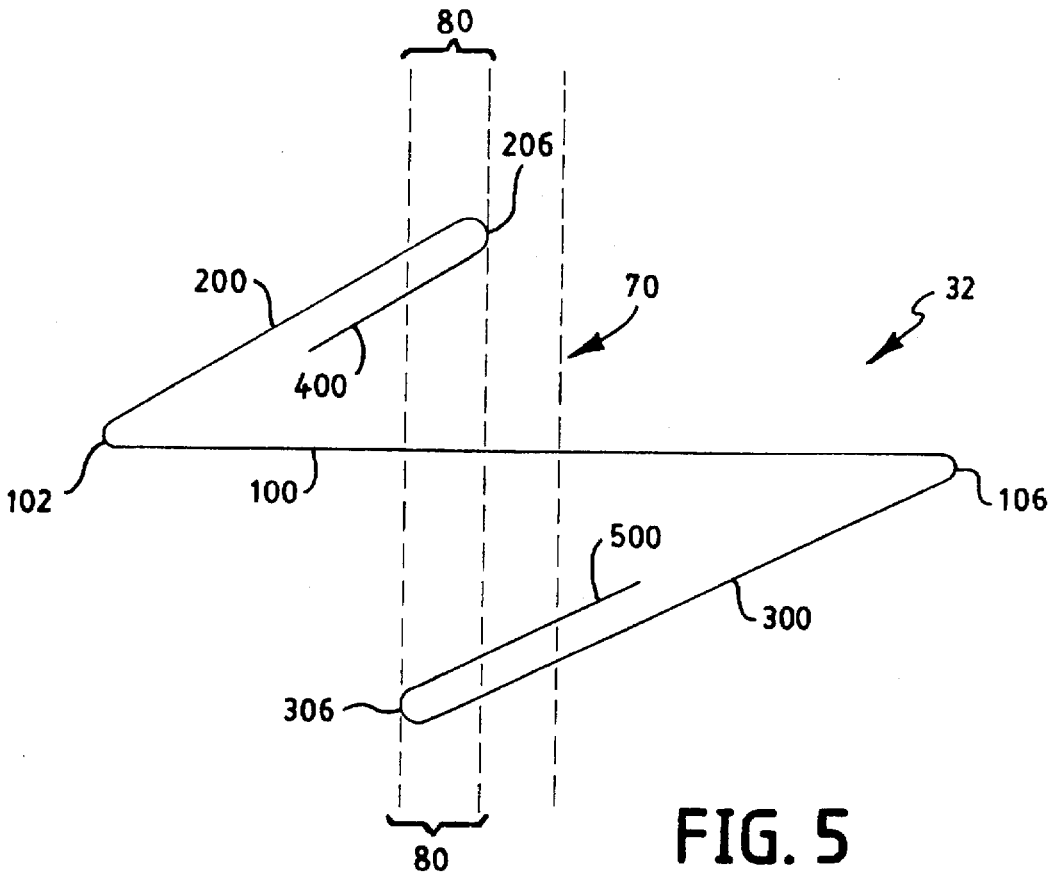
FIG. 5 is an illustration of a cross section of an exemplary improved dispensable folded web product.
Figure 6:
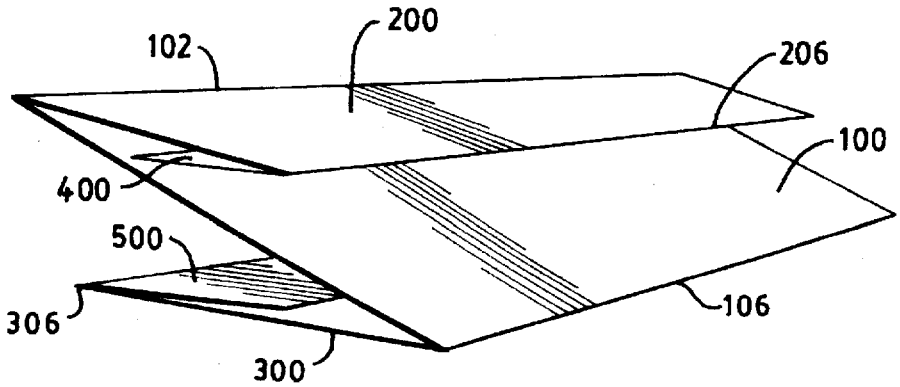
FIG. 6 is a perspective view of an exemplary improved dispensable web product depicted in FIG. 5.

The folded web product 32 includes a first central panel 100 that has a first fold line 102 at a first end 104 and a second fold line 106 at a second end 106 that is opposite from the first end 104. The folded web product 32, further includes a second panel 200 having a first end 202 that is joined with the first panel 100 at the first fold line 102 and a second end 204 having a third fold line 206 defined thereat. A third panel 300 having a first end 302 that is joined with the first panel 100 at the second fold line 106 further includes a second end 304 having a fourth fold line 306 defined thereat. The folded web product 32 also includes a fourth panel 400 that is joined to the second panel 200 at the third fold line 206. The fourth panel 400 is folded with respect to the second panel 200 at the third fold line 206 so that fourth panel 400 is positioned substantially between the first panel 100 and the second panel 200. Similarly, the improved web product 32 includes a fifth panel 500 that is joined to the third panel 300 at the fourth fold line 306. The fifth panel 500 is folded with respect to the third panel 300 at the fourth fold line 306 so that the fifth panel 500 will be positioned substantially between the third panel 300 and the first panel 100 when folded as shown in FIGS. 4, 5 and 6.

A first edge 60 of the folded web product 32 is defined on an end of the fourth panel 400 that is opposite from the third fold line 206. Similarly, the folded web product 32 includes a second edge 62 that is on the fifth panel 500 and is positioned opposite from the fourth fold line 306. Since the fourth and fifth panels 400, 500 are folded so as to be between the second and third panels 200, 300, respectively, and the first panel 100, the first and second edges 60, 62 will not be readily visible to an observer.

An important feature of the present invention is that the combined width of the second and third panels 200, 300 are greater than the width of the first panel 100, which will insure that the web product 32 has a zone or region of non-uniform thickness extending across the length of the folded web product in a central region when the product is folded flat.

The width of the first panel 100 is defined as being the distance from the first fold line 102 to the second fold line 106. The width of the second panel 200 is defined as being the distance from the first fold line 102 to the third fold line 206, and the width of third panel 300 is defined as being the distance from the second fold line 106 to the fourth fold line 306.

Figure 7:
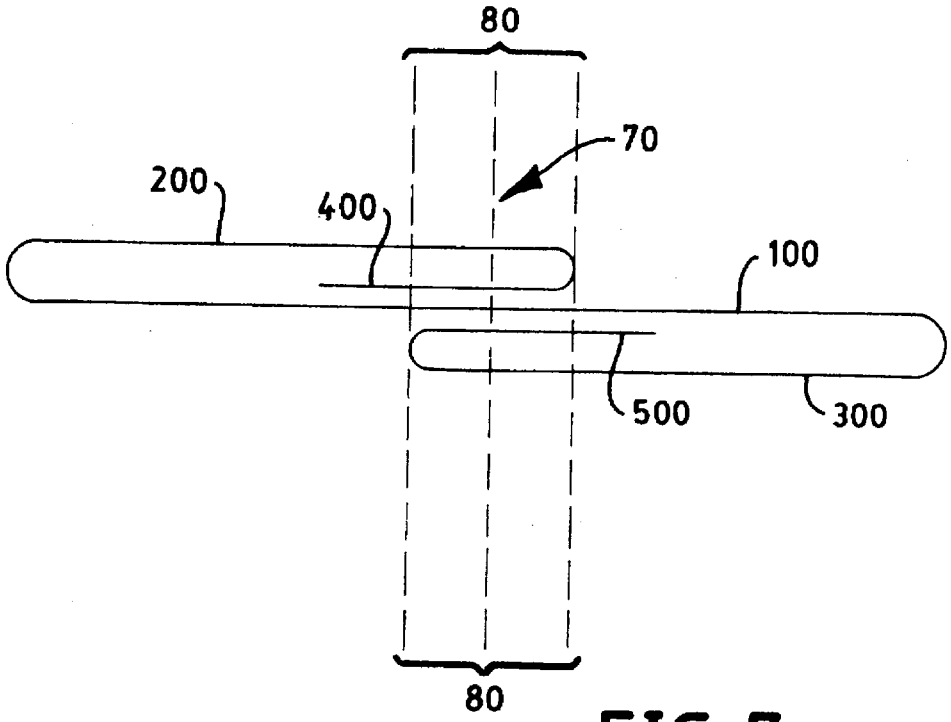
FIG. 7 is an illustration of a cross section of an exemplary improved dispensable folded web product depicted in FIG. 3, shown in a compressed folded state.

A mid-point 70 of the distance on first panel 100 between first fold line 102 and second fold line 106 is indicated in FIGS. 4 and 7. In the embodiment of FIGS. 4, 6 and 7, the second panel 200 and the third panel 300 have the same width which, in combination, is greater than the width of the first panel 100. This causes the third fold line 206 to be positioned on an opposite side of the mid-point 70 from first fold line 102 and the fourth fold line 306 to be positioned on the opposite side of the mid-point 70 from the second fold line 206. Such a configuration causes a portion of the second panel 200 and fourth panel 400 to overlap a portion of the third panel 300 and fifth panel 500 generating a zone or region 80 of non-uniform thickness across the length of the folded web product 32. As can be seen in FIGS. 4 and 7, the zone or region 80 of non-uniform thickness is centered on the mid-point 70.

In the embodiment of FIG. 5, the second panel 200 has a width that is less than the width of the third panel 300. Importantly, the combined width of the second panel 200 and the third panel 300 is greater than the width of the first panel 100 so a portion of the second panel 200 and fourth panel 400 to overlap a portion of the third panel 300 and fifth panel 500 generating a zone or region 80 of non-uniform thickness across the length of the folded web product 32. The lack of symmetry between the second panel 200 and the third panel 300 shifts the zone or region 80 of non-uniform thickness away from the mid-point 70. Such a configuration is desirable for dispensers having an offset opening.

According to an embodiment of the invention, the width of the fourth panel 400 may be less than one-half the width of the second panel 200. Alternatively and/or additionally, the width of the fifth panel 500 may be less than one-half the width of the third panel 300. Such a configuration enhances the difference in thickness (i.e., the non-uniform thickness) of the folded web product by concentrating the overlaying of the panels in the central region of the folded web product. For example, in the center of the folded web product, portions of the second panel 200, the fourth panel 400, the first panel 100, the fifth panel 500 and the third panel 300 will be stacked on over each other to provide a thickness equivalent to five (5) sheets of material. When the width of the fourth panel 400 is less than the second panel 200 (e.g., the fourth less than ½ the width of the second panel) and when the width of the fifth panel 500 is less than the third panel 300 (e.g., the fifth panel less than ½ the width of the third panel), the non-central regions or outer regions of the folded sheet product have a thickness equivalent to only two (2) sheets of material. Thus, the outer regions of the folded sheet product have a thickness that is less than one-half (i.e., ⅖) the thickness of the central region.

Figure 8:
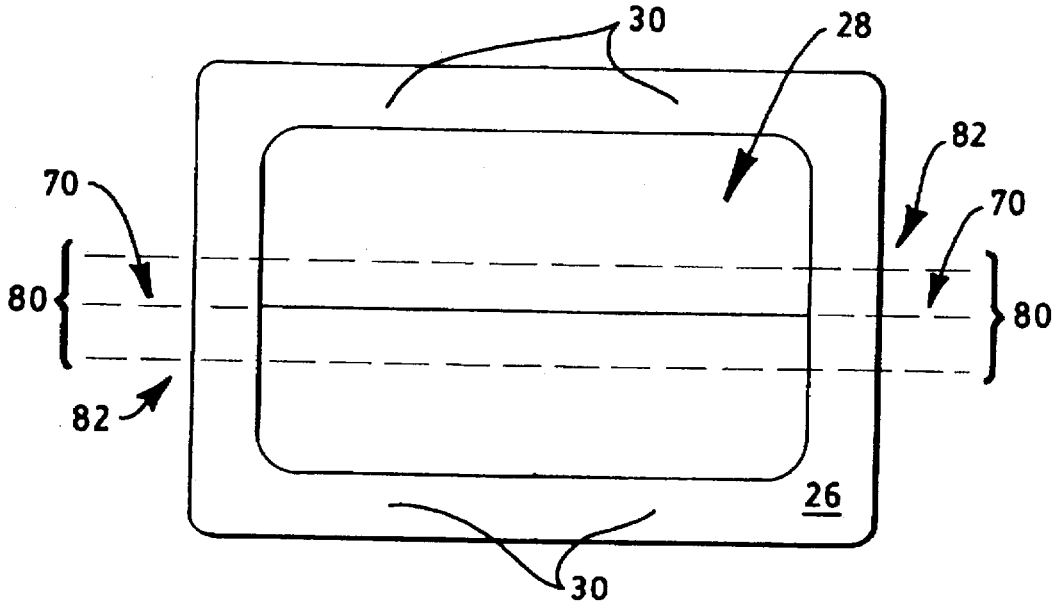
FIG. 8 is a front view illustration of a dispenser containing of an exemplary improved dispensable web product.

In the past, it was generally thought that folded web products should be configured to eliminate areas of non-uniform thickness. However, the configuration of non-uniform thickness in the present invention discussed above provides several advantages. Referring now to FIG. 8 of the drawings, there is shown a front view illustration of a dispenser 26 containing an exemplary improved dispensable web product 32. According to a feature of the present invention, the zone or region 80 of non-uniform thickness (which is aligned generally at the mid-point 70 or at some offset from the mid-point 70) contacts only small, "centrally located" sections 82 of the dispenser instead of the entire upper or lower edge 30 as with a conventional overfold type product.

Contact between the zone or region 80 of non-uniform thickness at only small, "centrally located" sections 82 of the dispenser helps to minimize the amount of area that can be pressed against face of the dispenser when it is spring-loaded or overfilled. It is generally thought that minimizing this area of contact (of the thickest portion of the stack of folded products) will help reduce friction between the spring-loaded or overfilled stack of folded web product so that sheets may be dispensed easily and reliably.

Another advantage of the zone or region 80 of non-uniform thickness at only the small, "centrally located" sections 82 of the dispenser is that the thinner sections of a stack of the dispensable folded web products are located at the upper and lower edges 30 of the dispenser. Since pressure on the stack of folded web products is focused at its thickest section (i.e., the zone or region 80 of non-uniform thickness) which contacts only a small portion of the dispenser, the thinner sections of the stack of web products which are in contact with a greater portion of the dispenser (i.e., the upper and lower edges 30) are essentially free from pressure caused by spring-loading or overfilling.

Yet another advantage of the present invention is that the configuration of the zone or region 80 of non-uniform thickness causes that portion of a stack of folded web product to tend to "bow out", protrude, bulge, or project outward from the opening in the dispenser. Since the zone or region is aligned generally at the mid-point 70 or at some offset from the mid-point 70, the bulge or projection generally makes it easier to grasp an individual folded sheet product.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A dispensable, unitary folded web product comprising:

a first, central panel having first and second opposing surfaces, the first panel concluding at a first fold line at a first end and a second fold line at a second end that is opposite from the first end, the first panel having a width that is defined as a distance from the first fold line to the second fold line;

a second panel, the second panel having a first end that is joined with the first panel at the first fold line, and a second end having a third fold line defined thereat, the second panel having a width that is defined as a distance from the first fold line to the third fold line, the second panel being folded so it overlays a portion of the first surface of the first panel;

a third panel, the third panel having a first end that is joined with the first panel at the second fold line and a second end having a fourth fold line defined thereat, the third panel having a width that is defined as a distance from the second fold line to the fourth fold line, the third panel being folded so it overlays a portion of the second surface of the first panel;

a fourth panel, the fourth panel being joined to the second panel at the third fold line, the fourth panel being folded with respect to the second panel at the third fold line so that the fourth panel is positioned substantially between the first panel and said second panel; and a fifth panel, the fifth panel being joined to the third panel at said fourth fold line, said fifth panel being folded with respect to the third panel at the fourth fold line so that the fifth panel is positioned substantially between the third panel and the first panel, wherein the combined widths of the second panel and the third panel are greater than the first panel so the second and third panels overlap to generate a region of non-uniform thickness across the length of the product.

2. The web product of claim 1, wherein said web product comprises a continuous web having a first edge and a second opposite edge, the first edge being on the fourth panel opposite to the third fold line and the second edge being on the fifth panel opposite to the fourth fold line.

3. The web product of claim 1, wherein the folded web product is an absorbent paper product.

4. The web product of claim 1, wherein the folded web product is composed of a material made up of multiple plies.

5. The web product of claim 1, wherein the width of the second panel is greater than the width of the third panel so the folded web product is asymmetrical.

6. The web product of claim 1, wherein the width of the fourth panel is less than one-half the width of the second panel.

7. The web product of claim 1, wherein the width of the fifth panel is less than one-half the width of the third panel.

8. A stack of the dispensable, unitary folded web product according to claim 1.

9. A dispensable, unitary folded web product comprising:

a first, central panel having first and second opposing surfaces, the first panel concluding at a first fold line at a first end and a second fold line at a second end that is opposite from the first end, the first panel having a width that is defined as a distance from the first fold line to the second fold line;

a second panel, the second panel having a first end that is joined with the first panel at the first fold line, and a second end having a third fold line defined thereat, the second panel having a width that is defined as a distance from the first fold line to the third fold line, the second panel being folded so it overlays a portion of the first surface of the first panel;

a third panel, the third panel having a first end that is joined with the first panel at the second fold line and a second end having a fourth fold line defined thereat, the third panel having a width that is defined as a distance from the second fold line to the fourth fold line, the third panel being folded so it overlays a portion of the second surface of the first panel;

a fourth panel, the fourth panel being joined to the second panel at the third fold line, the fourth panel being folded with respect to the second panel at the third fold line so that the fourth panel is positioned substantially between the first panel and said second panel, wherein the width of the fourth panel is less than the width of the second panel; and a fifth panel, the fifth panel being joined to the third panel at said fourth fold line, said fifth panel being folded with respect to the third panel at the fourth fold line so that the fifth panel is positioned substantially between the third panel and the first panel, wherein the width of the fifth panel is less than the width of the third panel, wherein the width of the fourth panel is less than one-half the width of the second panel and the width of the fifth panel is less than one-half the width of the third panel, and wherein the combined widths of the second panel and the third panel are greater than the first panel so the second and third panels overlap to generate a region of non-uniform thickness across the length of the product.

10. The web product of claim 9, wherein said web product comprises a continuous web having a first edge and a second opposite edge, the first edge being on the fourth panel opposite to the third fold line and the second edge being on the fifth panel opposite to the fourth fold line.

11. The web product of claim 9, wherein the folded web product is an absorbent paper product.

12. The web product of claim 9, wherein the folded web product is composed of a material made up of multiple plies.

13. The web product of claim 9, wherein the width of the second panel is greater than the width of the third panel so the folded web product is asymmetrical.

14. A stack of the dispensable, unitary folded web product according to claim 9.

15. A dispensable, folded absorbent web product comprising:

a first, central panel;

a second panel, unitary with said first panel and folded over a first side of said first panel;

a third panel, unitary with the first panel, and folded over a second side of the first panel;

a fourth panel, unitary with the second panel, and folded so as to be positioned between the first and second panels; and a fifth panel, unitary with the third panel, and folded so as to be positioned between the first and third panels, wherein a portion of the third panel and fifth panel overlap a portion of the second panel and fourth panel generating an area of non-uniform thickness across the length of the product.

16. The web product of claim 15, wherein said web product comprises a continuous web having a first edge and a second opposite edge, the first edge being on the fourth panel opposite to the third fold line and the second edge being on the fifth panel opposite to the fourth fold line.

17. The web product of claim 15, wherein the folded web product is an absorbent paper product.

18. The web product of claim 15, wherein the width of the second panel is greater than the width of the third panel so the folded web product is asymmetrical.

19. The absorbent web product of claim 15, wherein the width of the fourth panel is less than one-half the width of the second panel.

20. The absorbent web product of claim 15, wherein the width of the fifth panel is less than one-half the width of the third panel.

21. A stack of the absorbent dispensable, unitary folded web product according to claim 15.

* * * * *